US005340356A

United States Patent [19]

Cole

[11] Patent Number: 5,340,356

[45] Date of Patent: Aug. 23, 1994

[54] COIN COUNTING DEVICE

[76] Inventor: Donald Cole, 35 Colguhoun Crescent, Hamilton, Ontario, Canada, L9C 4W7

[21] Appl. No.: 849,200

[22] Filed: Mar. 11, 1992

[51] Int. Cl.[5] ..... G07D 9/02; G07D 9/06

[52] U.S. Cl. ..... 453/59; 453/60; 206/0.84

[58] Field of Search ..... 453/58-62; 53/213, 254, 532; 206/0.8, 0.84

[56] References Cited

U.S. PATENT DOCUMENTS

| | | | |
|---|---|---|---|
| 200,080 | 2/1878 | Meaker | 453/60 X |
| 201,264 | 3/1878 | Meaker | 453/60 X |
| 422,258 | 2/1890 | Staats | 453/60 X |
| 442,892 | 12/1890 | Hock | 453/60 |
| 852,574 | 5/1907 | Norrington | 453/59 X |
| 1,130,978 | 3/1915 | Jackson | 453/61 X |
| 2,342,761 | 2/1944 | Simpson | 453/60 X |
| 2,441,486 | 5/1948 | Hagopian | 453/59 X |
| 3,736,947 | 6/1973 | Gdanski | 453/60 |
| 3,741,222 | 6/1973 | Honesto | 453/60 |
| 4,109,668 | 8/1978 | Malacheski | 453/60 X |
| 4,154,252 | 5/1979 | Elias | 453/59 |
| 4,492,243 | 1/1985 | Lombard | 453/59 |
| 4,545,394 | 10/1985 | Chang | 453/60 |
| 4,700,533 | 10/1987 | Green | 53/532 |
| 4,764,151 | 8/1988 | Sandhage | 453/59 |
| 4,950,203 | 8/1990 | Tomaiko | 453/60 X |

FOREIGN PATENT DOCUMENTS

| | | | |
|---|---|---|---|
| 267919 | 1/1969 | Austria | 453/60 |
| 1539906 | 9/1968 | France | 453/59 |
| 529232 | 11/1957 | Italy | 453/59 |
| 530615 | 11/1957 | Italy | 453/61 |
| 536398 | 5/1958 | Italy | 453/60 |
| 631116 | 12/1961 | Italy | 453/59 |
| 2224142 | 4/1990 | United Kingdom | 453/60 |

*Primary Examiner*—Michael S. Huppert
*Assistant Examiner*—Scott L. Lowe
*Attorney, Agent, or Firm*—Eugene J. A. Gierczak

[57] ABSTRACT

A device for counting coins, organizing standard bank rolls, and aiding in the wrapping of coins having an upper surface presenting a depression having a cross-section adapted to receive coins, the depression having a first abutment at one end thereof and a second abutment at the other end thereof, marking scale adjacent to the depression located on the upper surface, and a rail projecting upwardly from the upper surface and along the upper surface, merging with the second abutment whereby coins may be measured when bearing against the rail inside or outside of the depression, by viewing the marking scale.

20 Claims, 18 Drawing Sheets

COIN COUNTING DEVICE

FIELD OF THE INVENTION

This invention relates to a device for counting coins, organizing standard bank rolls, and aiding in the wrapping of coins which allows for the determination of a quantity or value of coins within a depression or while resting against the rail and upon the measuring scale of the upper surface, and aids the operator in the organizing and wrapping of a quantity of coins, and more particularly allows for the determination of a quantity of coins based on a predetermined standard quantity or value of coins to be counted and aids the operator in the wrapping of coins in accordance with a predetermined standard, using a standard bank wrapper to create a standard bank roll or the like.

BACKGROUND TO THE INVENTION

Various apparatus for counting or wrapping coins have heretofore been devised.

For example, U.S. Pat. No. 3,736,947 [Gdnaski] discloses a coin counter or verifier comprising a base having at least one straight side and a lip offset from the base forming an obtuse angle with an outwardly slanting portion of the base, the lip rigidly supporting a plurality of regularly spaced ribs, the ribs extending upwardly from the lip and outwardly from the base, the spacing of the ribs being denominationally related to the coins to be counted. Further the plurality of ribs which extend upwardly from the lip and outwardly from the base and which divide the coins at regular intervals have a thickness of less then that of the coin to be counted.

Furthermore, U.S. Pat. No. 3,741,222 [Honesto] discloses a coin holder and counting device which receives and holds a plurality of coins in stacked relationship and determines the total value of a particular stack of coins. This coin holder and counting device comprises a board, each individual groove being formed to receive a defined stack of coins, having indicator means mounted adjacent to the groove for measuring the height of the stack of the coins, the indicator means having a plurality of indicator segments pivotally mounted for rotation about its axis parallel to the longitudinal axis of the groove, the indicator segments each comprise a flat plate having a thickness equal to the thickness of the coin type whose stack height is to be measured, the segments being rotatably mounted to engage the stacked coins in edge-to-edge contact so that when the segments are registrably engaged with a coin stack the number of segments engaged equal the total number of coins in the stack.

Another device described in U.S. Pat. No. 4,154,252 [Elias] disclosed a device for use in the wrapping of coins. This device for use in the wrapping of coins comprises a tray and a coin scoop, the tray being formed with a plurality of longitudinally extending receptacles, each receptacle having a coin count abutment wall projecting in the longitudinal direction. The projection of the coin count abutment wall being associated to the desired coin count for the coin of the denomination represented by the associated receptacle. The coin scoop is removably disposed in any one of the receptacles dependent on the denomination of the coins to be wrapped, the coin scoop cooperating with the tray to be indexed to occupy a predetermined position and a receptacle, the coin scoop comprising a longitudinally disposed trough having a wall at its proximal end and being opened at its free end, the free end of the trough extending at least to the coin count abutment wall, the trough being arranged to receive a stack of coins of the same denomination to form a column of coins with a select configuration with the axis thereof extending in a longitudinal direction, stacking the coins in the trough at its proximal end to the coin count abutment wall and fills the trough with a predetermined number of coins of the same denomination.

Moreover, U.S. Pat. No. 2,441,486 [Hagoplan] discloses a coin stacker for stacking and counting coins and packaging them in wrappers of predetermined widths depending upon the respective coin denominations, comprising an elongated base member, the uppermost longitudinal face thereof having a pair of end flanges presenting inner facing shoulders, the distance between the inner facing shoulders being sufficient for a width of a wrapper of a particular denomination, longitudinal face having an arcuate groove, terminating at the end flanges for seating coins of a particular denomination, a frame member of a length to be received between the end flanges having at each end an arcuate depending lug adapted to fit in the coin groove, the frame member being sufficiently heavy to cause its pair of depending lugs to conform the wrapper placed on the uppermost face of the base member to the arcuate shape of its coin groove, frame member having a central opening of a length to receive a predetermined number of coins of a particular denomination.

Finally, U.S. Pat. No. 1,130,978 [Jackson] discloses a coin wrapping device comprising in combination a body having an unobstructed open inclined v-shaped groove, a bridge member at the lowermost end of the groove and a stop finger projecting from the member along the axis of the groove and separated therefrom.

Each of the prior devices referred to above presents structures which do not include a rail in combination with a depression and measuring scale means. Further, some of the disclosed devices have moveable supplemental or accessory parts which may become detached, damaged or dislodged. Finally, some of the devices referred to above present structures which are cumbersome, awkward to store, and awkward to operate appearing to be complicated and time consuming.

It is the object of this invention to provide a device for counting coins, organizing standard bank rolls, and aiding in the wrapping of coins, which is easily adaptable to coin denominations in foreign jurisdictions, or other tasks regarding quick determination of quantity and/or value of coins. It is a further object of this invention to provide a device which allows for rapid visual counting and immediate determination of a quantity or value of the coins measured and to visually identify different coins inadvertently combined.

It is a further object of this invention to produce a device for counting coins, organizing standard bank rolls, and aiding in the wrapping of coins which is simple to operate, easily readable and accurate allowing the user to quickly organize and determine quantity or value of the measured coins and to aid in the quick wrapping of the coins. It is a further object of this invention to provide a device with defined segments to receive and house coins, to aid in the sorting of particular coin denominations. It is a further object of this invention to provide a device for counting coins, organizing standard bank rolls and aiding in the wrapping of coins, which is lightweight, thin, rigid, easily manufactured, and economically produced. It is a further object of this invention to provide a device for counting coins, organizing standard bank rolls and aiding in the wrapping of coins, having dimensions which allow it to be placed on a counter and easily stored in a drawer, binder or other area.

It is a further object of this invention to provide a device for counting coins, organizing standard bank rolls and aiding in the wrapping of coins, having a measuring capability on its surface in combination with a wrapper edge and wrapper end guides to aid in the locating of the wrapper in an optimal position to allow for quick wrapping of coins. It is a further object of this invention to provide a device having a depression with a particular length to aid the operator in organizing the coins into standard bank rolls, and to aid the operator when wrapping the coins which are organized into standard bank roll sizes and to create the initial wrapper end folds.

Other objects and advantages will appear hereinafter.

The broadest aspect of this invention relates to a coin counting device having an upper section presenting an upper planar surface, at least one depression having a cross section adapted to receive coins, each said at least one depression having a first abutment wall at one end thereof and a second abutment wall at an opposite end thereof, marking scale means adjacent said depression observable from said upper surface, and a rail projecting upwardly and along said upper surface, said rail merging with said second abutment wall so that said rail and second abutment wall define a planar abutment surface whereby said coins may be measured when bearing against said planar abutment surface inside or outside of said depression, by viewing said marking scale means, a backboard, wherein said upper section is secured to said backboard, and a filler disposed between said upper section and said backboard.

It is another aspect of this invention to provide a coin counting device comprising an upper section and a backboard, said upper section and said backboard having a generally rectangular shape defining a longitudinal length and a transverse width and secured to one another using an adhesion means, said upper section having an upper surface presenting a plurality of segments defined by inner ridges and perimetric ridges, said inner ridges and perimetric ridges projecting upwardly from said upper surface, each said segments having: a depression having a cross-section to receive coins; said depression having a longitudinal axis positioned at an angle less than forty-five degrees relative to said longitudinal length of said upper section; said depression having a first abutment wall at one end thereof and a second abutment wall at the other end thereof; a rail projecting upwardly from said upper surface presenting a rail abutment wall merging with said second abutment wall so as to define a planar abutment surface to allow for measuring coins on said upper surface or in said depression; marking scale means having a series of demarkation lines located on said upper surface identifying the cumulative value of the coins placed one against the other in a vertical orientation against said planar abutment surface for comparing the length of coins positioned one against the other thereby disclosing to the user the value of coins located in said depression or on said upper surface.

It is another aspect of this invention to provide the combination of a device for counting coins, organizing standard bank rolls and aiding in the wrapping of coins, and wrapper wherein: said device comprises an upper section including an upper surface having a plurality of depressions, a backboard and a filler having openings aligning with said depressions, said upper surface, said filler and said backboard having a generally rectangular shape defining a longitudinal length and a transverse width, with said upper surface, said filler and backboard secured to one another using an adhesion means, said upper surface defining a plurality of segments, each said segment defined by inner ridges and perimetric ridges each said segments including: one of said plurality of depressions for receiving coins; each one of said plurality of said depressions having a first abutment wall at one end thereof and a second abutment wall at an opposite end thereof; a rail projecting upwardly from said upper surface presenting a rail abutment wall merging with said second abutment wall so as to define a planar abutment surface to allow for measuring coins on the upper surface or in said depression; marking scale means having a series of demarkation lines located on said upper surface identifying the cumulative value of the coins placed one against the other in a vertical orientation against said planar abutment surface for comparing the length of coins against said demarkation line so as to disclose to the user the value of coins located in said depression or on said upper surface; a wrapper adapted to wrap said coins together; and said upper surface including wrapper edge guide marking means and a wrapper end guide marking for proper positioning of said wrapper when said wrapper overlies said rail, said depression and said first and second abutment walls; and with said wrapper deformable against said rail, said depression and said first and second abutment walls when pressed thereagainst by the user so as to aid in the wrapping of said coins.

It is another aspect of this invention to provide a device for counting coins, organizing standard bank rolls and aiding in the wrapping of coins, said device having an upper surface and lower surface, each surface presenting at least one depression having a first abutment wall at one end thereof and a second abutment wall at the other end thereof, first and second marking scale means adjacent said depression located on said upper surface and said lower surface, respectively, a first rail merging with said first abutment on said upper surface, a second rail merging with said second abutment on said upper surface, a third rail merging with said first abutment on said lower surface, a fourth rail merging with said second abutment on said lower surface, said first and second rails projecting outwardly from said upper surface and said third and fourth rails projecting outwardly from said lower surface, respectively, whereby said coins may be measured when bearing against said first or second rail or said third or fourth rail inside or outside of said depressions, by viewing said first or second marking scale means respectively.

DESCRIPTION OF DRAWINGS

These and other aspects and features shall now be described in relation to the following drawings.

DESCRIPTION OF THE INVENTION

Figure 1:
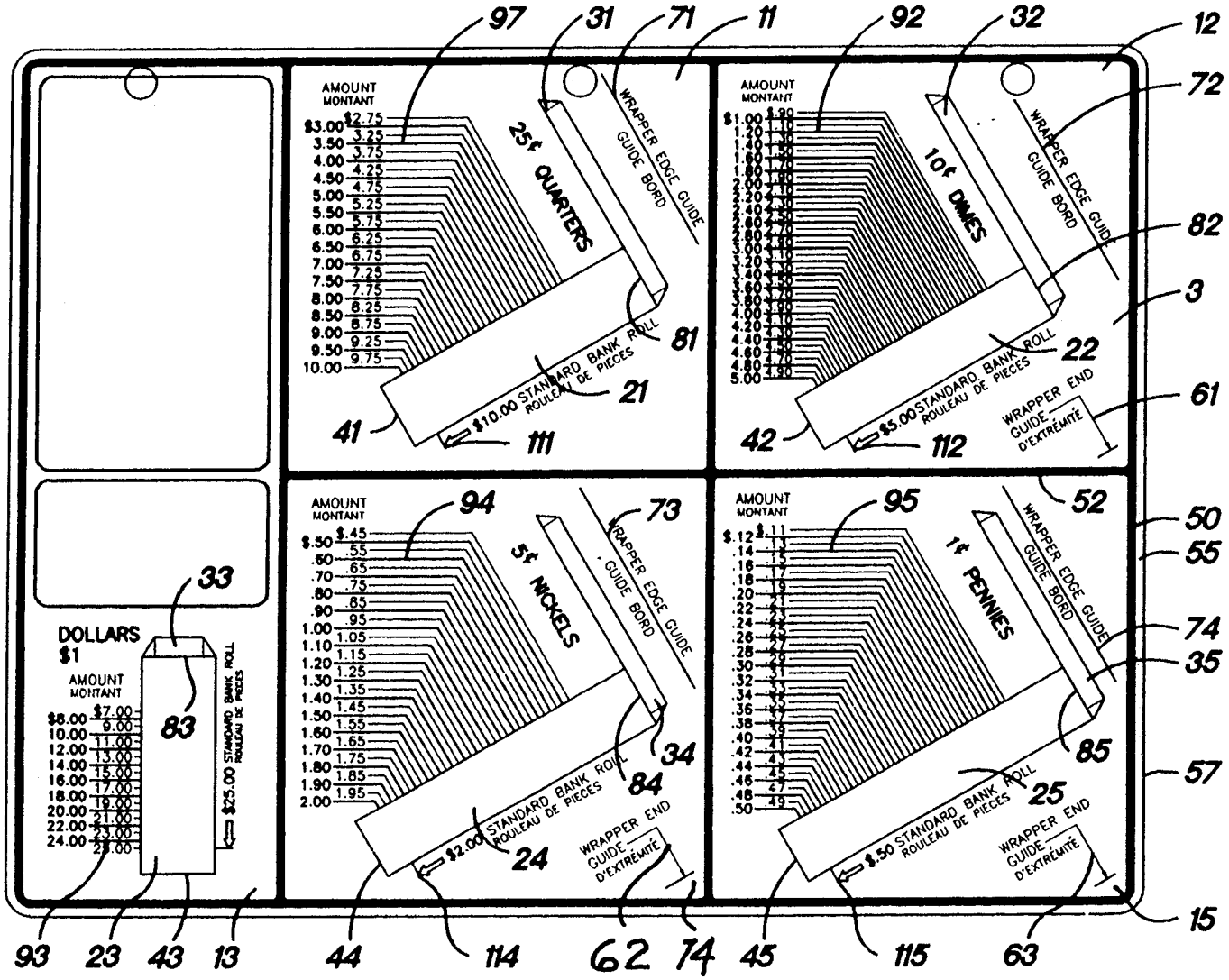
FIG. 1 is a detailed top plan view of the said device for counting coins, organizing standard bank rolls, and aiding in the wrapping of coins.

Like parts shall be given identical numbers throughout the figures.

The device for counting coins, organizing standard bank rolls and aiding in the wrapping of coins (hereinafter referred to as the "device") is generally depicted by a numeral 1 and comprises an upper section 2 having an upper surface 3, and a backboard 7 which are connected together by a lamination method. The upper surface 3 and backboard 7 may be constructed from one or a combination of numerous suitable materials including plastics, cardboards, woods or metals, the upper surface 3 preferably having a non-reflective surface. The device 1 may also include a filler 5, 6 which is located between the upper surface 3 and backboard 7 and may be solid 6 or perforated 5 provided the filler 5, 6 has openings coextensive with the depressions 21, 22, 23, 24, 25 in the upper surface 3. The filler 5, 6 may be constructed from one or a combination of numerous suitable materials including plastics, cardboards, woods or metals. The upper section 2 may include one or a plurality of depressions 21, 22, 23, 24, 25, 26, 27 having a first abutment wall 41, 42, 43, 44, 45, 46, 47 respectively, a second abutment wall 81, 82, 83, 84, 85, 86, 87 respectively, and a rail 31, 32, 33, 34, 35, 36, 37 respectively. The upper section 2 may be one segment or divided into a plurality of segments 11, 12, 13, 14, 15 created by a combination of continuously connected perimetrical ridges 50 and interior ridges 52. The upper section 2 has an easily readable marking scale 91, 92, 93, 94, 95, 96, 97 on the upper surface 3 and wrapper orientation guide scale including wrapper end guides 61, 62, 63 and wrapper edge guides 71, 72, 73, 74, 75, 76, 77, 78 on the upper surface 3 which enable the user to determine the quantity or value of the coins to be measured and to aid the user in organizing the coins, into standard bank roll size, and to aid the user in the process of wrapping the coins or other measurable objects including tokens, chips and discs. It is understood that the form of the invention herein described is to be taken as a preferred embodiment and that certain changes in the shape, size and arrangement may be made without departing from the spirit of the invention. In particular, it is understood that the form of the invention herein described is most easily adaptable to Canadian coins, however the invention is easily adaptable to the various foreign coin denominations found within other jurisdictions. For example in the United States, the dollar bill is the preferred format of denomination, and therefore the device would require depressions designated to count, organize and aid in the wrapping of four coin denominations one cent piece (penny), 5 cent piece (nickel), 10 cent piece (dime) and twenty-five cent piece (quarter). Differences would also result in the size of the depressions and measuring scale means due to the differing circumferences and widths of foreign coin denominations. It is anticipated that the quantity of coin types within a set of foreign coins will impact on the number of segments and the positioning of the segment or segments, in a generally vertical or horizontal orientation. It should also be understood that coins having a sufficiently broad width, will only require that their marking scale means consist of a set of parallel lines which are perpendicular to the longitudinal axis of the depression, and that coins having a sufficiently narrow width, may require that the rail be extended and that the marking scale means consist of a set of parallel lines which are angled, in order to create an increase in the distance between the parallel lines to enhance readability.

Referring now to FIG. 1, there is shown the upper section 2 having an upper surface 3 which has a perimetrical ridge 50 that defines the perimeter of the generally rectangular upper section 2. The perimetral ridge 50 is indented slightly from the side wall 57 of the upper surface 3, leaving a perimetral flange 55 between the side wall 57 of the upper surface 3 and the perimetrical ridge 50. There is a series of interior ridges 52 which merge perpendicularly at points along the perimetral ridges 50, to form five segments 11, 12, 13, 14, 15. The combination of perimetral ridges 50 and interior ridges 52 which project upwardly from the upper surface 3, protect the working surface of the upper surface 3, while working with device, during storage of device or while device is in transportation. The individual segments 11, 12, 13, 14, 15 allow the user to sort a coin denomination, into the defined segments 11, 12, 13, 14, 15 which are designated to measure that specific coin denomination and the combination of perimetrical ridges 50 and interior ridges 52 will keep separate the segregated coins from one segment 11, 12, 13, 14, 15 to another.

Within a segment 11, 12, 13, 14, 15 there exists a depression 21, 22, 23, 24, 25 respectively, each said depression 21, 22, 23, 24, 25 has a first abutment wall 41, 42, 43, 44, 45 respectively, a second abutment wall 81, 82, 83, 84, 85 respectively and a rail 31, 32, 33, 34, 35 respectively. Four of the depressions 21, 22, 24, 25 within segments 11, 12, 14, 15 respectively, are positioned on an angle relative to the horizontal length and vertical width of the upper surface 3 which matches the natural right handed position of a user when holding a number of coins placed in surface to surface contact between the thumb and another finger, often the index finger. The other depression 23 located within a segment 13, is positioned in a vertical position, with the longitudinal axis of the depression being generally parallel to the vertical axis of the upper surface 3 and the latitudinal axis of the depression 23 being generally parallel with the horizontal axis of the upper surface 3.

The upper surface 3 has impressed on it or adhered to it, a marking scale 91, 92, 93, 94 which consists of a series of a spaced lines separated by a width corresponding to the denomination of coin 100 which the segment is designed to measure.

The series of lines which are imprinted on or adhered to the upper surface 3 are perpendicular to the longitudinal axis of the depression 21, 22, 23, 24, 25. There also exists an additional line a bank roll measure marking 111, 112, 113, 114, 115 which is perpendicular to the longitudinal axis of the depression 21, 22, 23, 24, 25 positioned relative to the marking scale means which indicates the distance from the rail 31, 32, 33, 34, 35 to achieve a standard bank roll.

Four of the segments 21, 22, 24, 25 have within their boundaries a depression 21, 22, 24, 25 respectively, the longitudinal axis of which is disposed at an angle less than forty-five degrees relative to the horizontal axis of the upper surface 3. Depending on the placement of the depressions 21, 22, 24, 25 located within segments 11, 12, 14, 15 respectively, another series of lines are impressed or adhered to the upper surface 3, merging with the series of lines which are perpendicular to the longitudinal axis of the depression 21, 22, 24, 25 and which series of lines wherein each individual line is a different length, which length reduces uniformly from the line with the greatest length, the line closest to the rail 31, 32, 34, 35 to the line with the shortest length the line furthest from the rail 31, 32, 34, 35, the series of merging lines being parallel to the horizontal axis of the upper surface 3 each line being a different length which length reduces uniformly from the line with the greatest length, the line closest to the rail 31, 32, 34, 35 to the line with the shortest length, the line furthest from the rail 31, 32, 34, 35. The angle resultant at the point of merger of the two lines, creates an angle which corresponds to the position of the longitudinal axis of the depression 21, 22, 24, 25 relative to the vertical and horizontal axis of the upper surface 3. The series of lines when angled as described will cause an increase in the distance between the parallel lines which are perpendicular to the depression 21, 22, 24, 25 when compared to the merged lines parallel to the horizontal axis of the upper surface 3, thereby increasing the distance between the parallel lines where the marking scale is read by the user, increasing readability. At the end of the lines disposed parallel to the horizontal axis there will be symbols identifying quantity or value of the coin denomination to be measured which will be in horizontal orientation in vertical columns in the same color as the line which they identify. By joining these lines at an angle and the use of alternate colors for the lines, the user is assisted in reading the marking scale to determine coin quantity or value. The rails 31, 32, 34, 35 generally extend the length of the closest line perpendicular to the depression allowing for the placement of coins or the like against the rail wall for measurement on the upper surface 3 or in a depression 21, 22, 24, 25.

Four of the segments 21, 22, 24, 25 have impressed or adhered to the upper surface 3 wrapper edge guides 71, 72, 73, 74 wrapper end guides 61, 62, 63 and a standard bank roll measure marking 111, 112, 114, 115. The wrapper edge guide 71, 72, 73, 74 is parallel to the rail 31, 32, 33, 34 respectively and wrapper end guide 61, 62, 63 are parallel to the longitudinal axis of the depression 21, 22, 24, 25 respectively. The combination of these markings allows the user to overlay on the segment 11, 12, 14, 15 in use, including overlaying on the rail 31, 32, 34, 35 respectively, first abutment 41, 42, 44, 45 respectively, second abutment 81, 82, 83, 84 respectively, and depression 21, 22, 24, 25 respectively, with a standard bank roll wrapper 99. The user will overlay the wrapper 99 and align its edges using the wrapper edge guide 71, 72, 73, 74 and wrapper end guide 61, 62, 63 to generally centre the wrapper 99. The wrapper 99 will then be pressed into the depression 21, 22, 24, 25 using force extended by the user's finger, causing the edge of the wrapper 99 to "flip up". Once the pre-measured coins are placed against one another in surface to surface engagement and placed on the wrapper 99 in the depression 21, 22, 24, 25, the user continually applying force between their thumb and one other finger or fingers on either end of the series of coins placed in surface to surface engagement to form a coin cylinder, the user places the coin cylinder in the depression 21, 22, 24, 25 respectively which causes the wrapper 99 to crimp up at each edge to facilitate the initial edge fold, and wrapping the wrapper end which is aligned with the wrapper end guide around the coin cylinder and turning the coin cylinder within the depression 21 22, 24, 25 respectively.

The upper surface 3 in the fifth segment 13 has impressed on it or adhesed to it a marking scale which consists of a series of parallel spaced lines separated by a width corresponding to the denomination of coin which the segment is designated to measure. The series of lines which are impressed on or adhesed to the upper surface 3 are perpendicular to the longitudinal axis of the depression 23. The rail 33 spans the width of the depression 23 merging with the second abutment wall 83. The distance between the parallel lines is not increased by angling as the width of the coin denomination to be measured is significantly broad enough, however, the use of alternate colors for lines and symbols is used to assists the user in reading the marking scale. At the end of the line there will be symbols identifying the quantity or value of the coin denomination to be measured which will be in a horizontal orientation in vertical columns. In order for the user to wrap coins which are to be measured in segment 23, the user shall overlay the wrapper 99, including overlaying the rail 33, first abutment 43, second abutment 83, and depression 23 with a standard bank roll wrapper 99. When overlaying the standard bank roll wrapper 99 the user will allow the portion of the wrapper required to encircle the coins to extend past the depression 23. The wrapper 99 will then be pressed into the depression 23 using force exerted by the user's finger, causing the edges of the wrapper 99 to "flip up". Once the pre-measured coins are placed against one another in surface-to-surface engagement to form a coin cylinder, the coin cylinder is placed on the wrapper 99 in the depression 23 which causes the wrapper 99 to crimp up at each edge to facilitate the initial edge fold, the user continuously applying force between the thumb and one other finger or fingers on either end of the coin cylinder, and wrapping the wrapper 99 around the coin cylinder, turning the coin roll within the depression 23.

Figure 2:
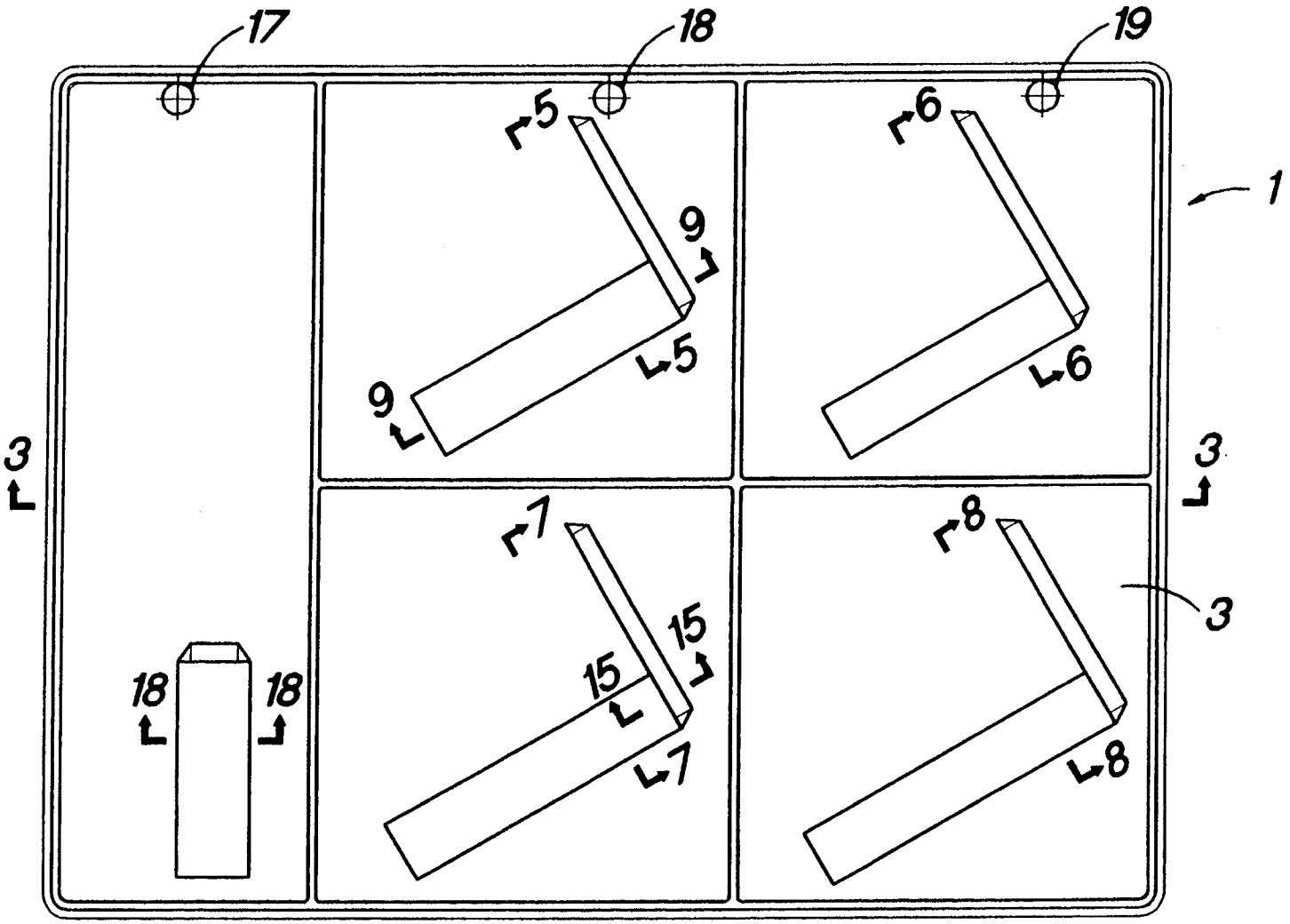
FIG. 2 is a top plan view of the said device for counting coins, organizing standard bank rolls, aiding in the wrapping of coins.

FIG. 2 illustrates the upper surface 3 without marking scales. The device 1 may have three holes 17, 18, 19 pierced through its components including the upper surface 3, filler 5, 6 and backboard 7 to allow for storage in a three-hole binder. It is possible to increase or decrease the number of holes, the width of those holes or the distance between the holes to accommodate the ability to store the device 1 in another format.

Figure 3:
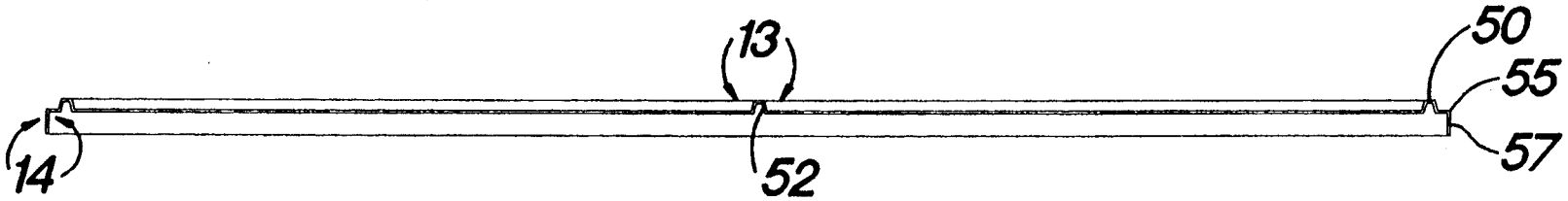
FIG. 3 is a cross-sectional view of the said device for counting coins, organizing standard bank rolls, and aiding in the wrapping of coins along line 3—3 of FIG. 2.

FIG. 3 illustrates the relative similarity of elevation of the interior ridges 52 and the perimetrical ridges 50. The interior ridges 52 and perimetrical ridges 50 are positioned parallel to the vertical axis of the upper surface or to the horizontal axis of the upper surface 3, with the exception of the four perimetrical ridge corners which are slightly rounded. The perimetrical ridges 50, and side wall 57 do not align, the perimetrical ridges 50 being identical creating a perimetrical flange 55.

Figure 4:
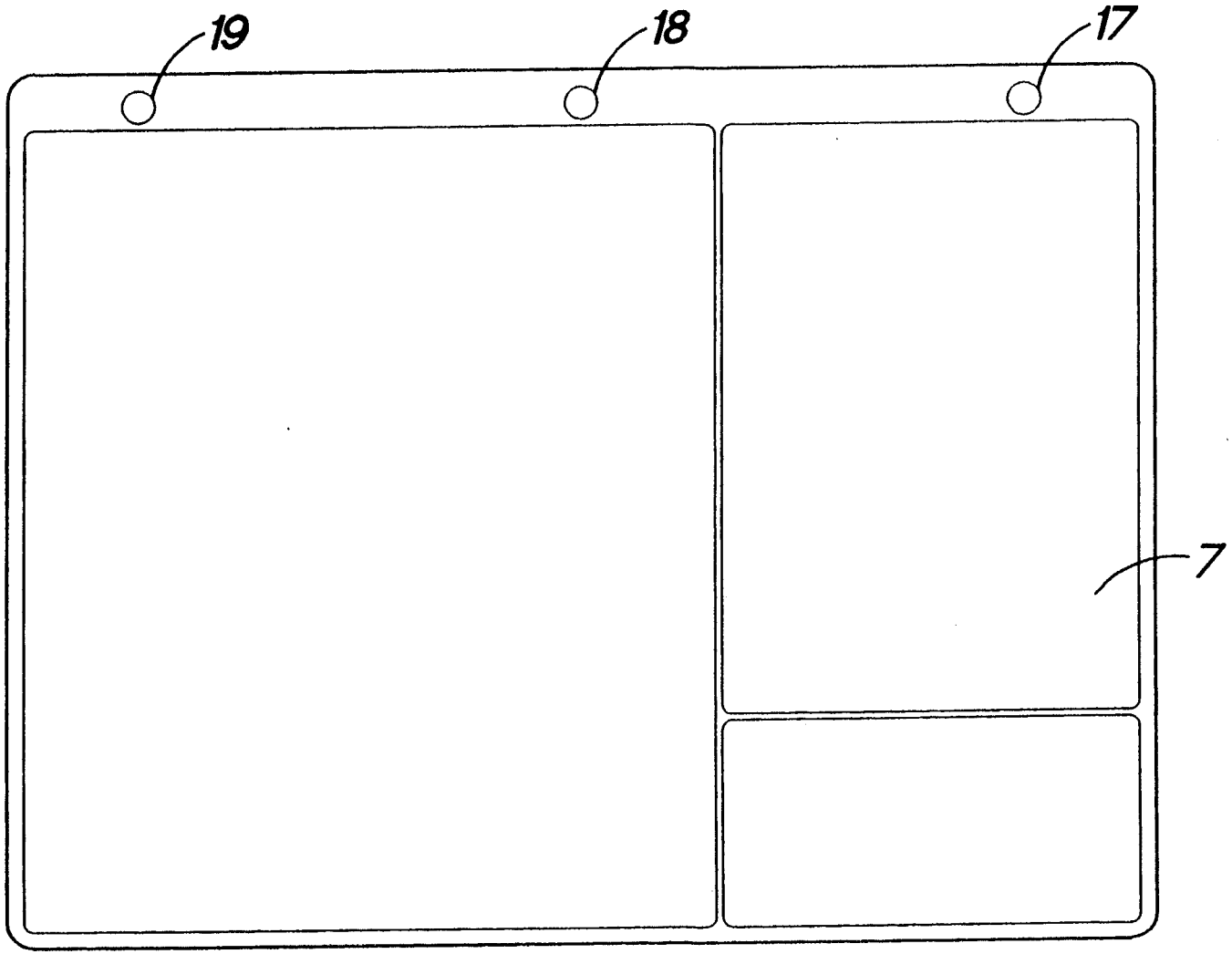
FIG. 4 is a bottom plan view of the said device for counting coins, organizing standard bank rolls, and aiding in the wrapping of coins.
Figure 5:
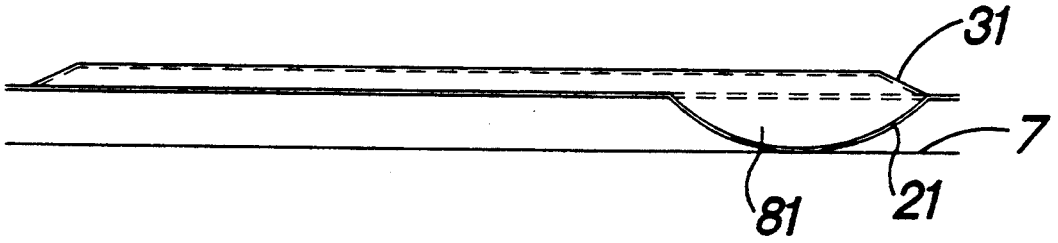
FIG. 5 is a cross-sectional view of the said device for counting coins, organizing standard bank rolls, and aiding in the wrapping of coins along line 5—5 of FIG. 2.
Figure 6:
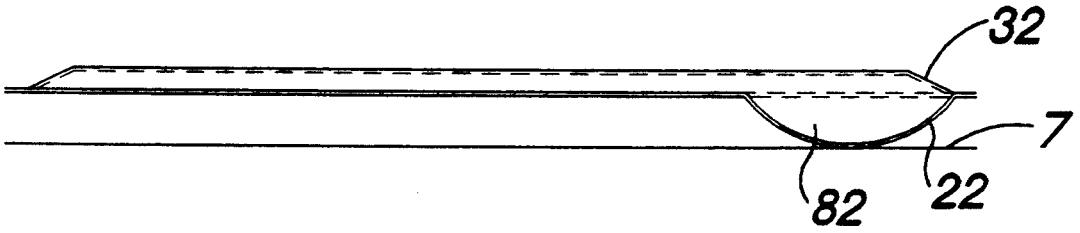
FIG. 6 is a cross-sectional view of the said device for counting coins, organizing standard bank rolls, and aiding in the wrapping of coins along line 6—6 of FIG. 2.
Figure 7:
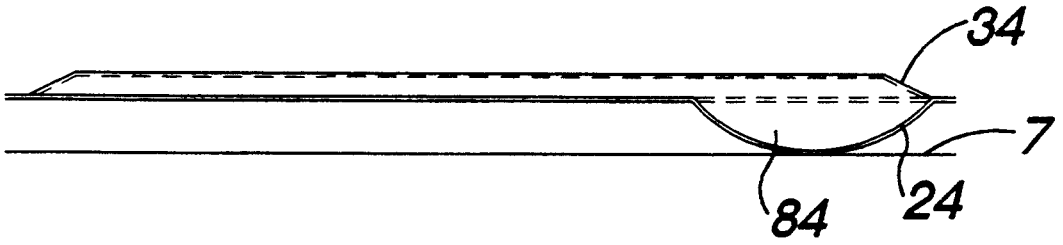
FIG. 7 is a cross-sectional view of the said device for counting coins, organizing standard bank rolls, and aiding in the wrapping of coins along line 7—7 of FIG. 2.
Figure 8:
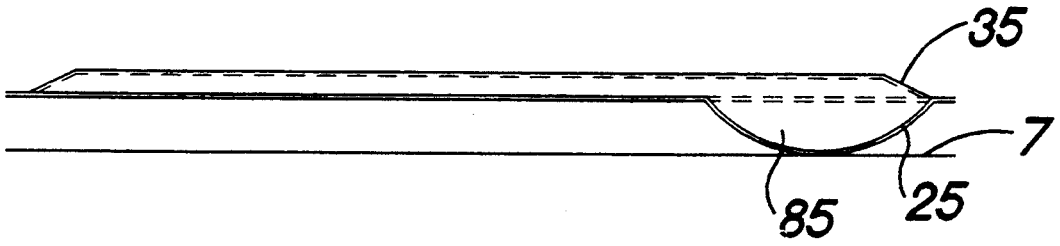
FIG. 8 is a cross-sectional view of the said device for counting coins, organizing standard bank rolls, and aiding in the wrapping of coins along line 8—8 of FIG. 2.

FIG. 4 illustrates the backboard 7 having three holes 17, 18, 19 pierced through it. The space on the backboard 7 could be made available for impressing or adhesing advertising messages, product information, identifiers or the like.

FIGS. 5, 6, 7 and 8 illustrate the depressions 21, 22, 24, 25 respectively, in relation to the rails 31, 32, 34, 35 respectively in segments 11, 12, 14 and 15 respectively, each of which has a different cross-section which corresponds to the particular size of the coin, which it is designed to measure. The depressions 21, 22, 24, 25 have a depth which allow them to come to rest at their greatest depth on the backboard 7, which allow the coins when accumulating in the depression 21, 22, 24, 25 to "sit up" when resting one coin against the other or allow the user to place the coins in the depression 21, 22, 24, 25 in vertical position on their edge. The arcuate depression 21, 22, 24, 25 is slightly greater than the perimeter presented by the corresponding coin which it is to measure. The slight increase in size of the depression 21, 22, 24, 25 relative to the size of the coin to be measured allows the coins positioned within the depression 21, 22, 24, 25 in surface to surface engagement to roll within the depression with or without a wrapper 99 interposed between the depression 22, 22, 24, 25 and the coins.

The rail 31, 32, 34, 35 and, the second abutment wall 81, 82, 84, 85 respectively are indistinguishably merged over the width of the depression 21, 22, 24, 25 and likewise the rail 31, 32, 34, 35 merges indistinguishably with the upper surface 3 along its contact with the upper surface 3. The rail 31, 32, 34, 35 have an elevation greater than the working surface of upper surface 3, and similar to that of the interior ridges 52 and perimetrical ridges 50.

Figure 9:
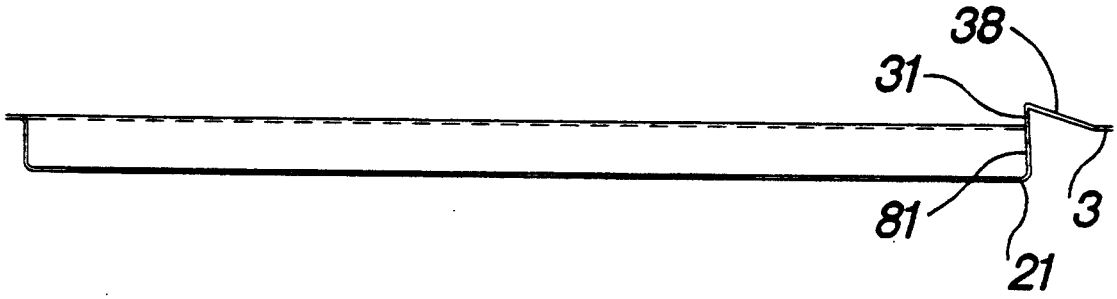
FIG. 9 is a cross-sectional view of the said device for counting coins, organizing standard bank rolls, and aiding in the wrapping of coins along line 9—9 of FIG. 2.

FIG. 9 illustrates the depression 21 relative to the rail 31 in segment 11. The rail 31 presents a generally triangular cross-section which merges with the second abutment wall 81 and the upper surface 3. The merger plane where the rail 31 merges with the second abutment wall 81, being indistinguishable. The rail 31 projects upwardly from the upper surface 3 to its highest elevation where there is a merger with the rail support wall 38 which slopes uniformly upwardly from a point of merger with the surface 3, to the point of merger at the top of the rail wall.

Figure 10:
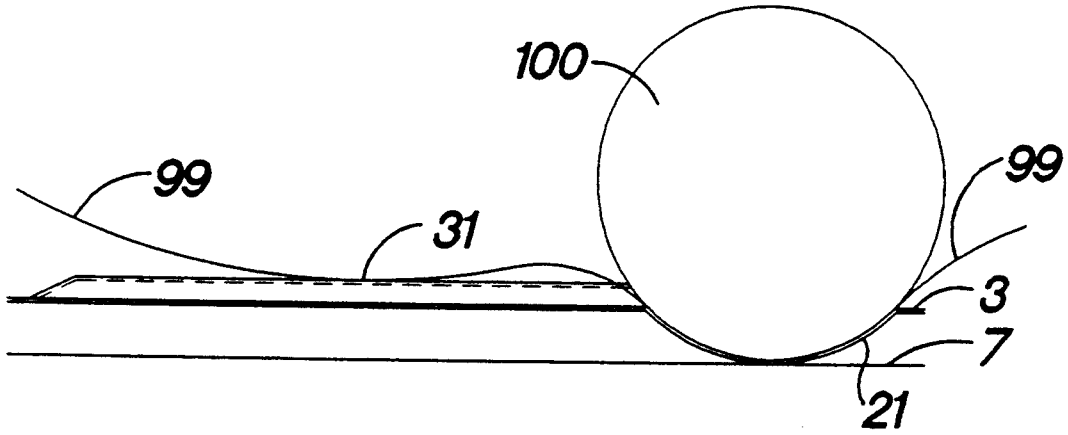
FIG. 10 is a cross-sectional view of the said device for counting coins, organizing standard bank rolls, and aiding in the wrapping of coins along line 5—5 of FIG. 2, having a coin located within the depression.

FIG. 10 illustrates the depression 21 in relation to the rail 31 in segment 11 wherein the depression is occupied by a coin 100. The arcuate depression 21 being slightly greater than the perimeter presented by the coin 100 which it is designed to measure. Likewise, the width of the depression 21 is slightly greater than the width of the corresponding coin 100 which is to be measured.

Figure 11:
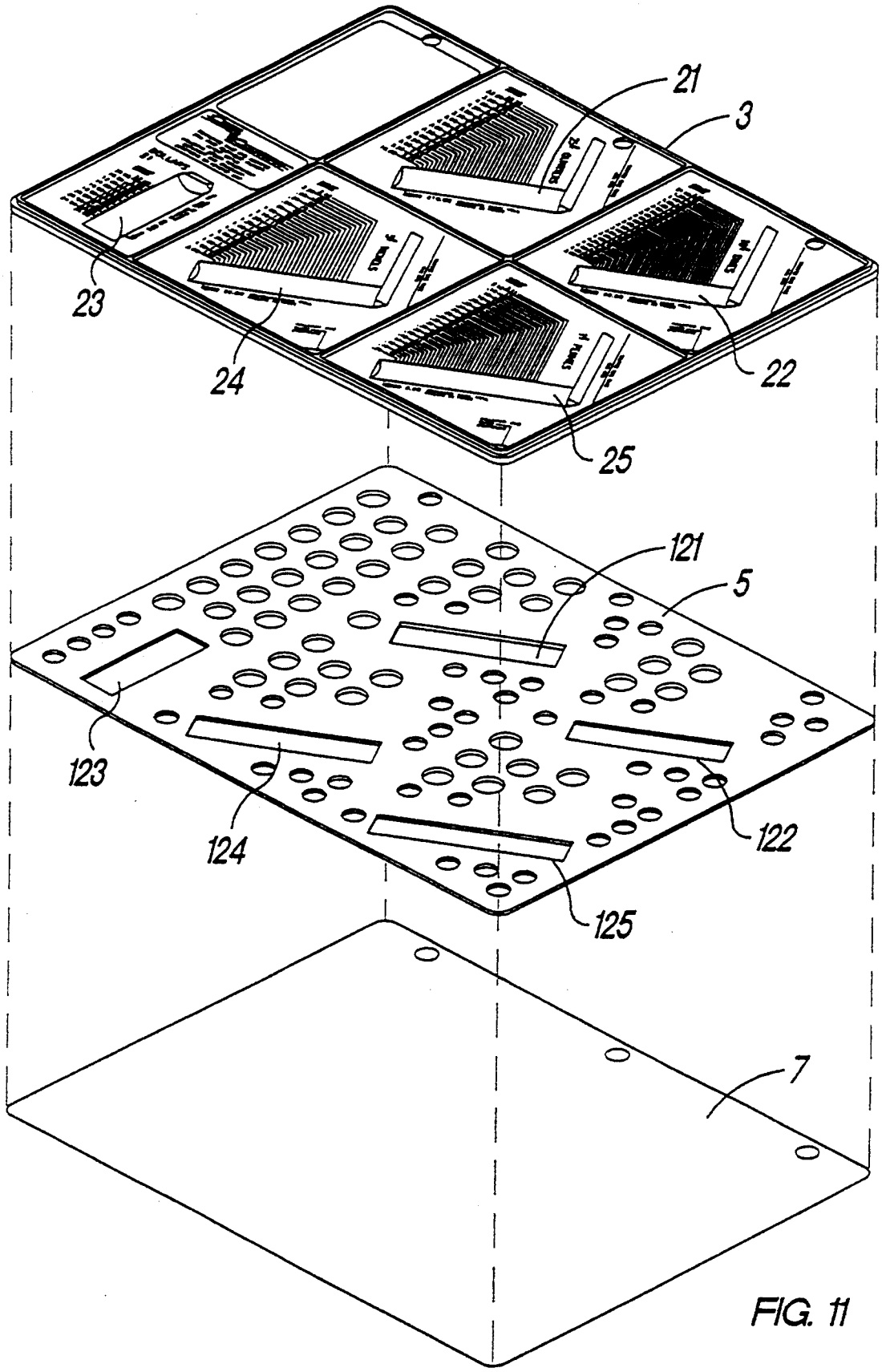
FIG. 11 is an exploded top perspective view of the said device for counting coins, organizing standard bank rolls, and aiding in the wrapping of coins having a perforated filler.

FIG. 11 illustrates the upper surface 3, a perforated filler 5 and the backboard 7. The upper surface 3 is normally constructed from a non-reflective plastic, the filler normally constructed from a corrugated cardboard material, and the backboard from a sturdier cardboard or plastic material. The perforated filler 5 having openings 121, 122, 123, 124, 125 to allow the depressions 21, 22, 23, 24, 25 to pass through the filler coming to a rest on the backboard 7.

Figure 12:
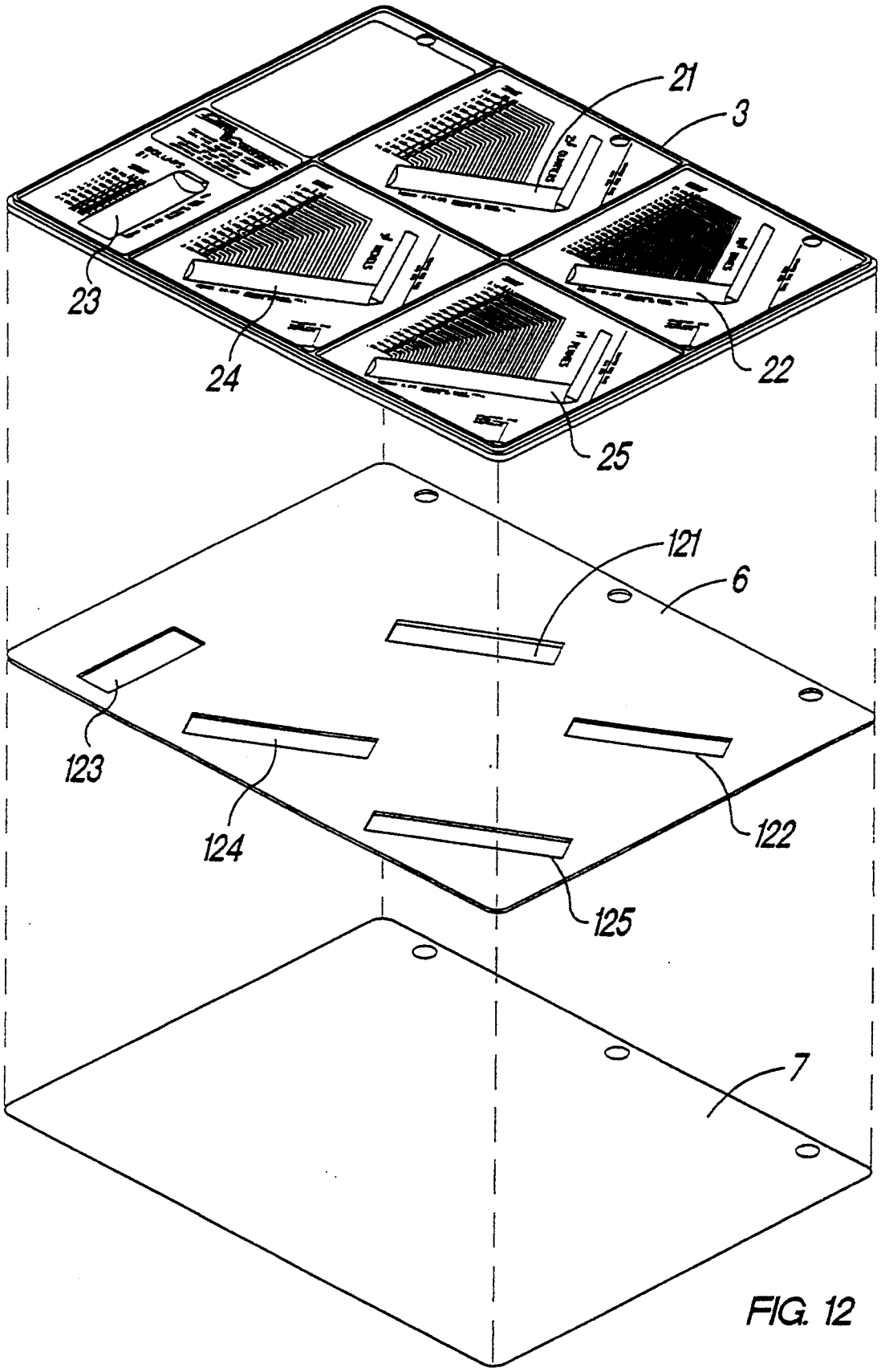
FIG. 12 is an exploded top perspective view of an alternative embodiment of the said device for counting coins, organizing standard bank rolls, and aiding in the wrapping of coins having a solid filler.

FIG. 12 illustrates an alternative embodiment of the coin counting device 1, having an upper surface 3, a solid filler 6 and backboard 7. The solid filler 6 normally constructed from a corrugated cardboard material. The solid filler 6 having openings 121, 122, 123, 124, 125 which allow the depressions 21, 22, 23, 24, 25 to pass through the solid filler 6 coming to a rest on the backboard 7.

Figure 13:
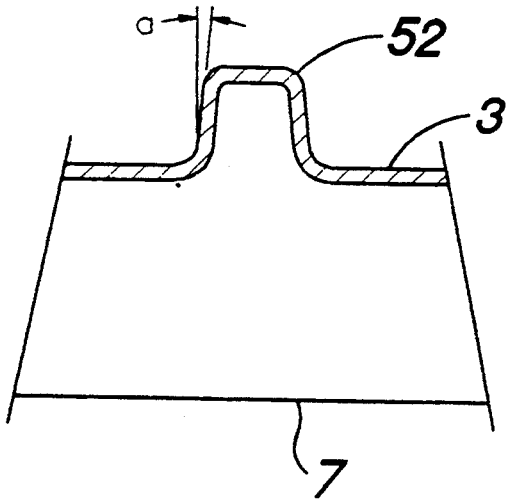
FIG. 13 is a cross-sectional view of an interior ridge of the said device for counting coins, organizing standard bank rolls, and aiding in the wrapping of coins along line 13—13 of FIG. 3.

FIG. 13 illustrates the generally rectangular cross-section of the interior ridges 52. The walls of the interior ridges 52 project outwardly from the upper surface 3 and at a slight uniform angle a, and merge with the upper surface 3.

Figure 14:
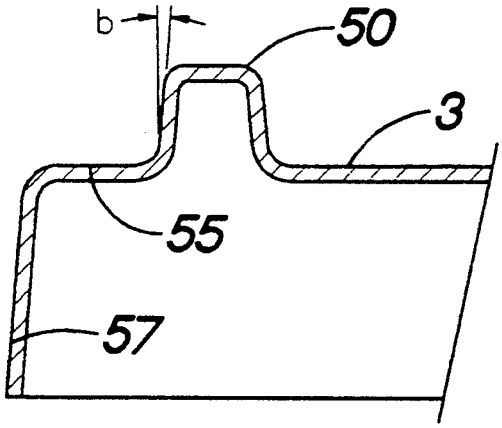
FIG. 14 is a cross-sectional view of a perimetrical ridge of the said device for counting coins, organizing standard bank rolls, and aiding in the wrapping of coins along line 14—14 of FIG. 3.

FIG. 14 illustrates the generally rectangular cross-section of the perimetrical ridges 50 the perimetrical flange 55, the side wall 57 and their merged general relation to one another. The walls of the perimetrical ridges 52 project outwardly from the upper surface 3 at a slight uniform angle b, and merge with the upper surface 3.

Figure 15:
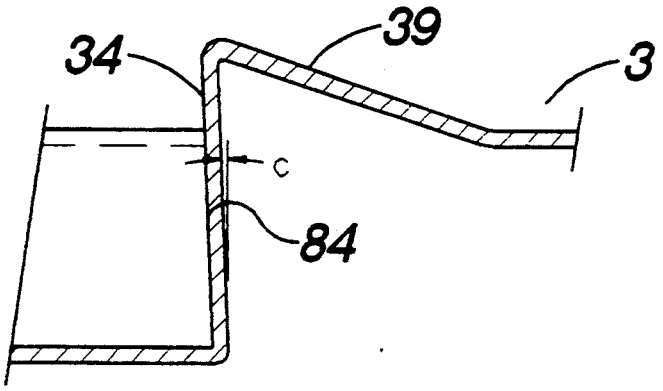
FIG. 15 is a cross-sectional view of a depression, second abutment wall, and rail of the said device for counting coins, organizing standard bank rolls, and aiding in the wrapping of coins along line 15—15 of FIG. 2.

FIG. 15 illustrates the rail 34 and its indistinguishable merger with the second abutment wall 84 and the rail support walls indistinguishable merger with the upper surface 3. The continual wall created by the rail wall and second abutment wall 84 respectively is at a slight uniform angle c.

Figure 16:
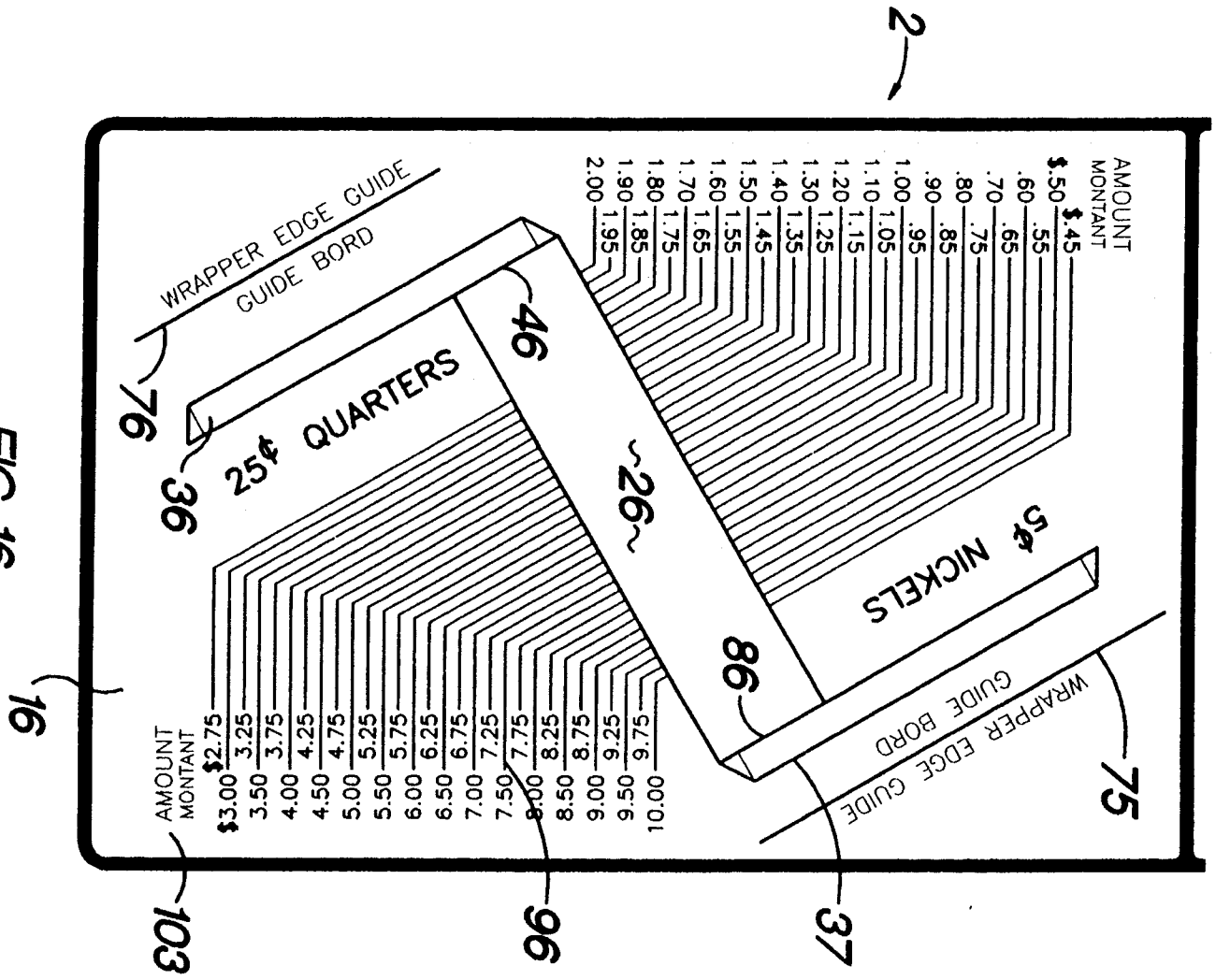
FIG. 16 is a detailed top plan view of an alternative embodiment of the said device for counting coins, organizing standard bank rolls, and aiding in the wrapping of coins.
Figure 17:
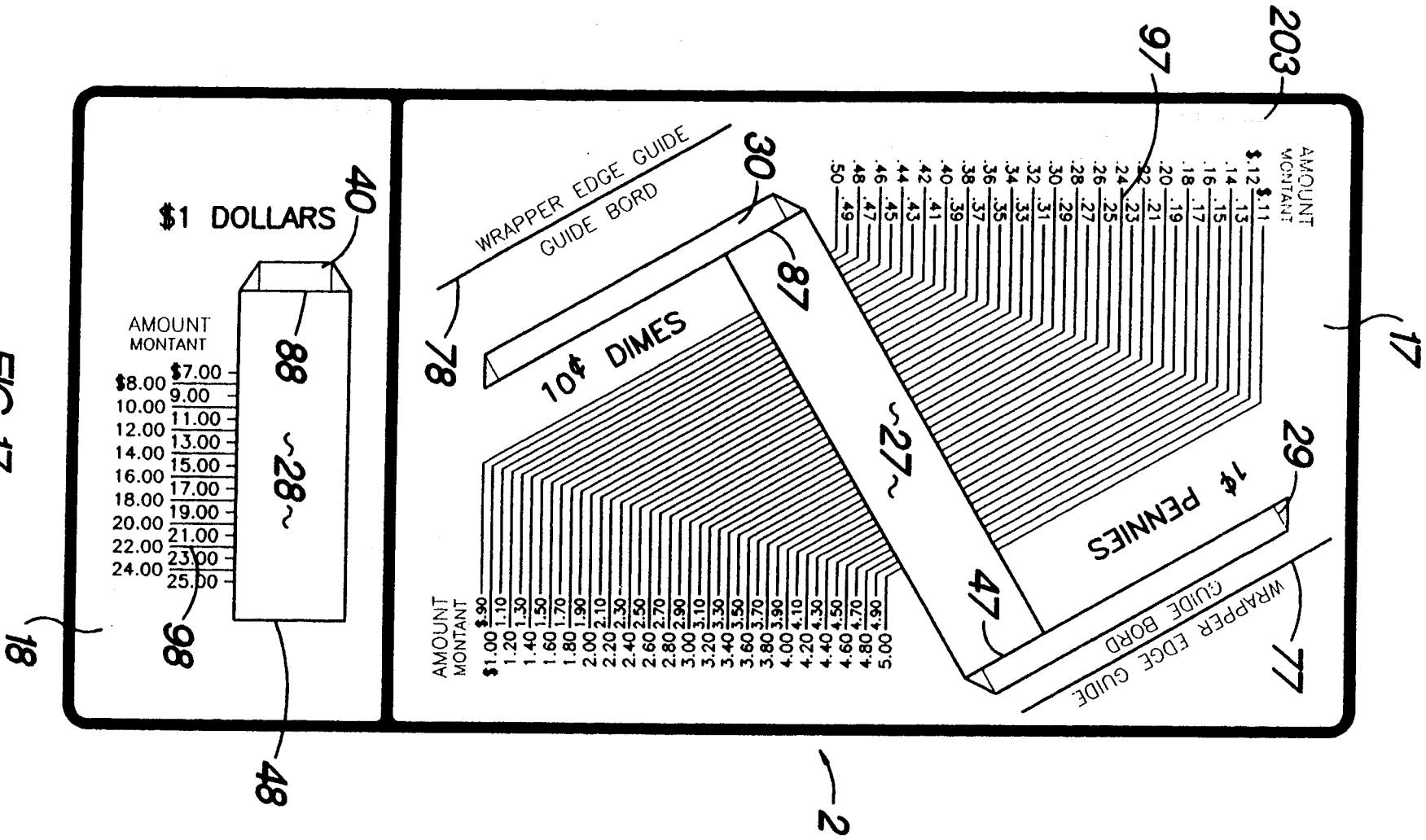
FIG. 17 is a detailed bottom plan view of an alternative embodiment of the said device for counting coins, organizing standard bank rolls, and aiding in the wrapping of coins.

FIGS. 16 and 17 illustrate an alternative embodiment of a device for counting coins, organizing standard bank rolls and aiding in the wrapping of coins. The alternative embodiment 2 has an upper surface 16 and lower surface 17 which may be constructed from one or a combination of numerous suitable materials including plastics, cardboards, or metals, the upper surface 16 and lower surface 17 preferably having a non-reflective surface, the upper surface 16 and lower surface 17 connected together by a lamination method and often include a filler disposed between the upper surface 16 and lower surface 17.

FIG. 16 illustrates the upper surface 16 which has at least one depression 26 having a first abutment wall 46 and a second abutment wall 86, each of the first abutment wall 46 and second abutment wall 86 having a rail 36, 37, respectively, and a marking scale means 96. Coins having similar width and circumferences can use a common depression providing the marking scale means is adapted to measure each of the coin denominations which the depression is intended to measure. The rails 36 and 37 extend along the upper surface allowing coins to be measured provided the coins in surface to surface engagement are placed against the rail 36, 37 inside of or outside of the depression.

FIG. 17 illustrates the upper surface 17 which has at least one depression 27 having a first abutment wall 47 and a second abutment wall 87, each of the first abutment wall 47 and second abutment wall 87 having a rail 29, 30 respectively, and a marking scale means 96. Coins having similar width and circumferences can use a common depression providing the marking scale means is adapted to measure each of the coin denominations which the depression is intended to measure. The rails 29 and 30 extend along the upper surface allowing coins to be measured provided the coins in surface to surface engagement are placed against the rail 36, 37 inside of or outside of the depression.

FIG. 17 illustrates a second depression 28, having a first abutment 48 and second abutment wall 88, which merges with rail 88 and which is measured by measuring scale means 98.

Figure 18:
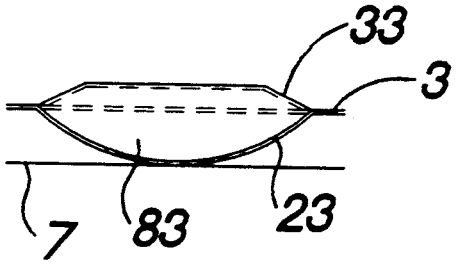
FIG. 18 is a cross-sectional view the said device for counting coins, organizing standard bank rolls, and aiding in the wrapping of coins along line 18—18 of FIG. 2.

FIG. 18 illustrates the depression 23 in relation to the rail 33 in segment 13, having a cross-section which corresponds to the particular size of coin which it is designed to measure. The depression 23 has a depth which allows it to come to rest at its greatest depth on the backboard 7, which allows the coins when accumulating in the depression 23 to "sit-up" when resting one coin against the other or allows the user to place the coins in the depression 23 in a vertical position on their edge. The arcuate depression 23 is slightly greater than the perimeter presented by the corresponding coin which it is to measure. The slight increase in size of the depression 23 relative to the size of the coin to be measured allows coins positioned within the depression 23 in surface-to-surface engagement to roll within the depression with or without a wrapper interposed between the depression 23 and the coins.

The rail 33 and second abutment wall 83 are indistinguishably merged over the width of the depression 23. The rail 33 having an elevation greater than the working surface of the upper surface 3, and similar to that of the interior ridges 52 and perimetrical ridges 50.

Although the preferred embodiments as well as the operation and use have been specifically described in relation to the drawings, it should be understood that variation in preferred embodiment can be achieved by a person skilled in the art without departing from the spirit of the invention. It is therefore intended that the foregoing detailed description be regarded as illustrative rather than limited and that it be understood that it is the following claims including all equivalents that are intended to define the scope of this invention. Accordingly the invention should not be understood to be limited to the exact form revealed by the drawings.

The embodiments of the invention in which an exclusive property or privilege is claimed are defined as follows:

1. A coin counting device having an upper section presenting an upper planar surface, at least one depression having a cross section adapted to receive coins, each said at least one depression having a first abutment wall at one end thereof and a second abutment wall at an opposite end thereof, marking scale means adjacent each said at least one observable from said upper surface, and a rail projecting upwardly and along said upper surface, said rail merging with said second abutment wall so that said rail and second abutment wall define a planar abutment surface whereby said coins may be measured when bearing against said planar abutment surface inside or outside of said depression, by viewing said marking scale means, a backboard, wherein said upper section is secured to said backboard, and a filler disposed between said upper section and said backboard.

2. A coin counting device as claimed in claim 1 wherein said filler has openings aligning with each said depression, said filler secured to said upper section and said backboard using an adhesion means.

3. A coin counting device as claimed in claim 2 wherein said upper section, said filler, and said backboard have a plurality of aligned holes.

4. A coin counting device as claimed in claim 3 wherein there are three said aligned holes.

5. A coin counting device as claimed in claim 4 wherein there said upper surface section, said filler, and said backboard have a generally rectangular shape.

6. A coin counting device as claimed in claim 5 wherein said upper section has perimetric ridges.

7. A coin counting device as claimed in claim 6 including a plurality of depressions and inner ridges defining a plurality of segments wherein each said segment includes one of said plurality of depressions.

8. A coin counting device as claimed in claim 7 wherein each of said plurality of depressions is adapted to count a different coin denomination.

9. A coin counting device as claimed in claim 8 wherein said upper section of each said segment has a wrapper edge guide marking means and a wrapper end guide means identifying the proper positioning of a wrapper relative to each of said depressions for ease of wrapping of said coins.

10. A coin counting device as claimed in claim 8, wherein said inner ridges and said perimetric ridges have a generally rectangular cross section defining said segments.

11. A coin counting device as claimed in claim 10 wherein said perimetric ridges are recessed inwardly from sidewalls of said upper surface creating a flange around the perimeter of said upper surface.

12. A coin counting device as claimed in claim 11 wherein said rectangular shape of said upper surface defines a longitudinal length and transverse width of said upper section, and wherein each of said plurality of depressions present a longitudinal axis disposed at an angle less than forty-five degrees relative to the said longitudinal length of said upper section.

13. A coin counting device as claimed in claim 12 wherein said marking scale means has a series of demarkation lines which run perpendicular to said longitudinal axis of each said depression.

14. A coin counting device as claimed in claim 13 wherein said inner ridges, said perimetric ridges and said rail means project outwardly from said upper surface each having generally the same elevation in relation to said upper surface.

15. A coin counting device as claimed in claim 13 wherein each said segment includes a wrapper edge guide marking means and wrapper end guide means for receiving a wrapper to wrap coins wherein said wrapper is adapted to align with said wrapper edge guide marking means and said wrapper end guide means and overlay said rail, and said depression of each of said segments and said first and second abutment walls; and said wrapper is deformable against said rail, said depression, and said first and second abutment walls when pressed thereagainst by a user so as to aid in wrapping of said coins.

16. A coin counting device comprising an upper section and a backboard, said upper section and said backboard having a generally rectangular shape defining a longitudinal length and a transverse width and secured to one another using an adhesion means, said upper section having an upper surface presenting a plurality of segments defined by inner ridges and perimetric ridges, said inner ridges and perimetric ridges projecting upwardly from said upper surface, each said segments having:

a. a depression having a cross-section to receive coins; said depression having a longitudinal axis positioned at an angle less than forty-five degrees relative to said longitudinal length of said upper section;

b. said depression having a first abutment wall at one end thereof and a second abutment wall at the other end thereof;

c. a rail projecting upwardly from said upper surface presenting a rail abutment wall merging with said second abutment wall so as to define a planar abutment surface to allow for measuring coins on said upper surface or in said depression;

d. marking scale means having a series of demarkation lines located on said upper surface identifying the cumulative value of the coins placed one against the other in a vertical orientation against said planar abutment surface for comparing the length of coins positioned one against the other thereby disclosing to the user the value of coins located in said depression or on said upper surface.

17. A coin counting device as claimed in claim 16 wherein each of said plurality of depressions includes a lower surface and said planar abutment surface is disposed at an acute angle relative said lower surface of each of said plurality of depressions respectively.

18. A coin counting device as claimed in claim 16 wherein said demarkation lines on said upper surface extend along said transverse width so as to clearly identify the cumulative value of said coins.

19. The combination of a device for counting coins, organizing standard bank rolls and aiding in the wrapping of coins, and wrapper wherein:

a. said device comprises an upper section including an upper surface having a plurality of depressions, a backboard and a filler having openings aligning with said depressions, said upper surface, said filler and said backboard having a generally rectangular shape defining a longitudinal length and a transverse width, with said upper surface, said filler and backboard secured to one another using an adhesion means, said upper surface defining a plurality of segments, each said segment defined by inner ridges and perimetric ridges each said segments including:

i. one of said plurality of depressions for receiving coins;

ii. each one of said plurality of said depressions having a first abutment wall at one end thereof and a second abutment wall at an opposite end thereof;

iii. a rail projecting upwardly from said upper surface presenting a rail abutment wall merging with said second abutment wall so as to define a planar abutment surface to allow for measuring coins on the upper surface or in said depression;

iv. marking scale means having a series of demarkation lines located on said upper surface identifying the cumulative value of the coins placed one against the other in a vertical orientation against said planar abutment surface for comparing the length of coins against said demarkation line so as to disclose to the user the value of coins located in said depression or on said upper surface;

b. a wrapper adapted to wrap said coins together; and c. said upper surface including wrapper edge guide marking means and a wrapper end guide marking for proper positioning of said wrapper when said wrapper overlies said rail, said depression and said first and second abutment walls; and with said wrapper deformable against said rail, said depression and said first and second abutment walls when pressed thereagainst by the user so as to aid in the wrapping of said coins.

20. A device for counting coins, organizing standard bank rolls and aiding in the wrapping of coins, said device having an upper surface and lower surface, each surface presenting at least one depression having a first abutment wall at one end thereof and a second abutment wall at the other end thereof, first and second marking scale means adjacent said depression located on said upper surface and said lower surface, respectively, a first rail merging with said first abutment on said upper surface, a second rail merging with said second abutment on said upper surface, a third rail merging with said first abutment on said lower surface, a fourth rail merging with said second abutment on said lower surface, said first and second rails projecting outwardly from said upper surface and said third and fourth rails projecting outwardly from said lower surface, respectively, whereby said coins may be measured when bearing against said first or second rail or said third or fourth rail inside or outside of said depressions, by viewing said first or second marking scale means, respectively.

* * * * *